US005318460A

United States Patent [19]

Gilbert

[11] Patent Number: 5,318,460

[45] Date of Patent: Jun. 7, 1994

[54] ELECTRICAL CONNECTORS

[75] Inventor: Hugh H. Gilbert, Cambridge, United Kingdom

[73] Assignee: Rotacon Limited, Cambridge, United Kingdom

[21] Appl. No.: 937,838

[22] PCT Filed: Apr. 17, 1991

[86] PCT No.: PCT/GB91/00601

§ 371 Date: Oct. 19, 1992

§ 102(e) Date: Oct. 19, 1992

[87] PCT Pub. No.: WO91/16739

PCT Pub. Date: Oct. 31, 1991

[30] Foreign Application Priority Data

Apr. 18, 1990 [GB] United Kingdom ..... 9008680

[51] Int. Cl.[5] ..... H01R 13/00

[52] U.S. Cl. ..... 439/621

[58] Field of Search ..... 439/620-622, 439/656, 692-697

[56] References Cited

U.S. PATENT DOCUMENTS

| | | | |
|---|---|---|---|
| 1,988,725 | 1/1935 | Glade, Jr. | 439/656 |
| 2,083,836 | 6/1937 | Glade, Jr. | 439/656 |
| 2,435,341 | 2/1948 | Crumrine | 439/656 |
| 2,482,965 | 9/1949 | Cook | 439/656 |
| 2,692,316 | 10/1954 | Graziosi | 439/621 |
| 3,980,380 | 9/1976 | Cieniawa et al. | 439/656 |
| 4,196,409 | 4/1980 | Juba | 439/621 |

FOREIGN PATENT DOCUMENTS

| | | |
|---|---|---|
| 0277800 | 8/1988 | European Pat. Off. . |
| 828563 | 1/1952 | Fed. Rep. of Germany . |
| 76175127 | 6/1977 | Fed. Rep. of Germany . |
| 2562334 | of 1985 | France . |
| 2198598A | 6/1988 | United Kingdom . |

*Primary Examiner*—Joseph H. McGlynn

*Attorney, Agent, or Firm*—Dann, Dorfman, Herrell and Skillman

[57] ABSTRACT

According to the invention a wire trap comprising co-acting first and second parts carried by respective first and second components of a housing for the trap, which housing defines a wire passage leading to the trap and which components are relatively movable from an open condition of the trap, in which a wire end may be interposed between the separated parts, to a closed condition of the trap, in which the wire end is bent transverse to the wire passage by the first part and is trapped in contact with the second part by the first part, is characterised in that the first part is provided with a slot in the end thereof which is closest to the second part, said slot narrowing in the direction away from said end, whereby a wire end can become wedged in the slot as well as being trapped between the first and second parts.

12 Claims, 2 Drawing Sheets

ELECTRICAL CONNECTORS

TECHNICAL FIELD

This invention relates to a wire trap having first and second parts which coact to trap a wire end therebetween to leave at least one of said parts in secure electrical communication with the wire end.

The invention is expected to find its main application in electrical connectors (e.g. power plugs, switches and sockets) and in particular connectors in which closing of the wire trap is occasioned by a relative movement between two components of the connector, the said movement causing the wire end to be bent transversely as it enters the closing trap. A particularly important application is expected to be connectors in which a turning movement of one component relative to the other (e.g. through substantially a right angle) is used to close the wire trap around the wire end. One example of a connector employing such wire traps is described in GB-B-2198598 and EP-A-0277800 and in these prior art examples each trap comprises male and female parts, the male part entering into the female part to trap a wire end therebetween.

One problem in connection with the operation of wire traps of the kind disclosed in the aforesaid patent specifications is the security of trapping of the wire end in the trap. In some circumstances, smaller diameter wire ends are less securely trapped than larger diameter wire ends. Entrapment which is less secure than a required minimum can lead to resistive heating of the wire trap on current flow and/or the risk of dislodgement of the wire end from the trap on the appearance of tension applied lengthwise of the wire leading to the trap. Both these effects are undesirable and this invention seeks to obviate these disadvantages.

SUMMARY OF THE INVENTION

According to the invention a wire trap comprising coacting first and second parts carried by respective first and second components of a housing for the trap, which housing defines a wire passage leading to the trap and which components are relatively movable from an open condition of the trap, in which a wire end may be interposed between the separated parts, to a closed condition of the trap, in which the wire end is bent transverse to the wire passage by the first part and is trapped in contact with the second part by the first part, is characterised in that the first part is provided with a slot in the end thereof which is closest to the second part, said slot narrowing in the direction away from said end, whereby a wire end can become wedged in the slot as well as being trapped between the first and second parts.

The first part can be a blade exhibiting a generally V-shaped slot and the second part can be a plate-shaped member against which the wire end is pressed by the first member. Conveniently, however, the second part is a generally U-shaped receptor (the plane of the U being normal to the plane of the V) into which the blade enters in the closed condition of the trap.

Typically both first and second parts will be of electrically conducting material but this is not necessary provided good electrical contact is secured between the wire end and one of the trap parts.

The shaping of the slot is not seen as being a critical factor and V-shaped slots of semi-angles in the range from under 10° to over 45° have been used successfully.

Conveniently the slot has a wide mouth to gather stray wires, but a shallow taper at the narrow end to provide an effective trapping action. In some circumstances (e.g. in a three-pin electrical plug), dimensional constraints limit the slot depth to some 5 mm and this may make a slot with curved edges desirable. One such slot with curved edges effectively gave a wide taper of semi-angle circa 50° at the mouth and a narrow taper of semi-angle circa 12° at the narrow end. A straight-edged V-shaped slot of semi-angle between 20° and 30° (preferably about 25°) and depth of between 4 and 6 mm measured along the line bisecting the angle has proved to be effective with a variety of stranded wire ends of cross-sectional areas in the range between 0.5 $mm^2$ and 1.5 $mm^2$.

For a pluri-wire connector (e.g. a three-pin electrical plug) a trap can be provided for each wire and these are conveniently ganged together whereby a relative movement of the component parts of the housing into the closed condition of the trap snags each wire in the slot of the first part of the respective trap, as the first part squeezes the wire between the two parts.

BRIEF DESCRIPTION OF DRAWINGS

The invention will now be further described, by way of example with reference to the accompanying drawings, in which.

DESCRIPTION OF PREFERRED EMBODIMENTS

Figure 2:
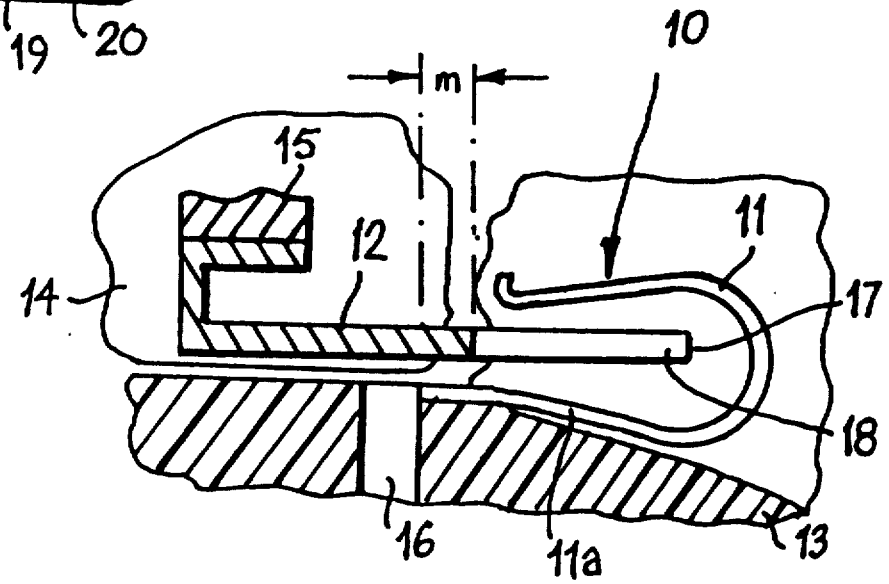
FIG. 2 is a schematic plan of a closed trap showing the male part in the female part, but without a wire present.

FIG. 2 shows a wire trap (generally designated 10) comprising a female part 11 partially surrounding a male part 12.

The part 11 can be a cradle of sprung steel strip captive in a first housing component 13 and the male part 12 can be a blade of electrically conducting material (e.g. brass or phosphor bronze) connected to a plug pin 15 mounted in a second housing component 14. The trap 10 is shown in closed condition in FIG. 2 but without a wire end trapped therein. A passage through which the wire passes to the trap 10 is shown schematically at 16 in FIG. 2. Where the cradle 11 is required to be currentcarrying it could be made of phosphor bronze.

Figure 1:
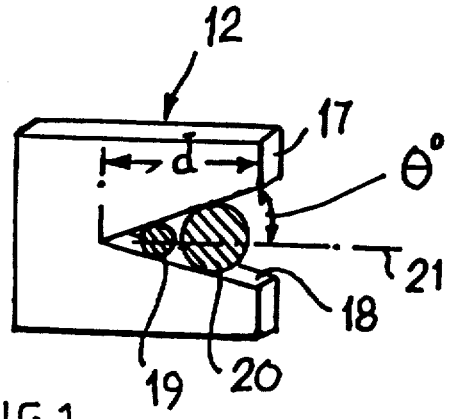
FIG. 1 is a schematic side view of a male trap part shown with a slot in its leading end and with two wires of different sizes located in the slot.

FIG. 1 shows the male part 12 and indicates how the leading end 17 of the blade is indented with a slot 18, the slot 18 narrowing in the direction away from the end 17. A thin wire end 19 and a thick wire end 20 are schematically shown in cross-section located in the slot in the respective position they naturally adopt when wedged therein.

Figure 3:
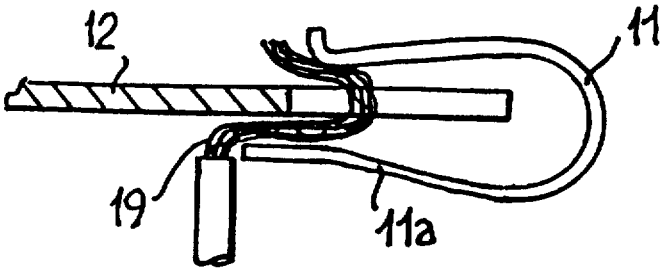
FIG. 3 shows the trap of FIG. 2 closed around a thin wire.
Figure 4:
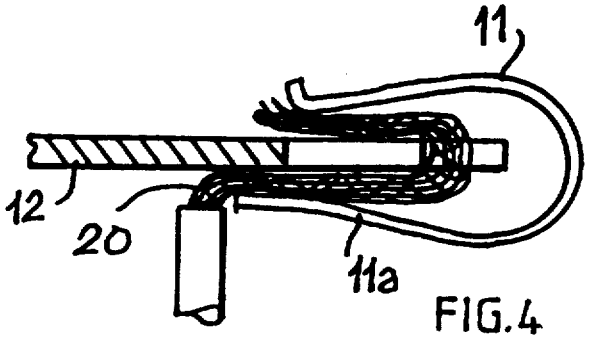
FIG. 4 shows the trap of FIG. 2 closed around a thick wire.

Because the slot 18 narrows in the direction away from the end 17, as the trap closes into the condition shown in FIGS. 3 and 4 (e.g. by moving the blade 12 to the right past the end of the passage 16 and into the cradle 11, or by moving the cradle 11 to the left relative to the blade 12), the wire end (19 or 20) gets drawn into the slot 18 as far as its diameter will allow and then gets wedged therein when the blade 12 is correctly located in the cradle 11. The condition for a thin wire end 19 is shown in FIG. 3 and for a thick wire end 20 is shown in FIG. 4. To accommodate stranded wires of cross-sectional areas ranging between 0.5 $mm^2$ and 1.5 $mm^2$, the slot 18 can have a depth "d" along the line bisecting the angle of 4.5 mm and a semi-angle $\theta$ of 26°.

The dashed line 21 in FIG. 1, which bisects the slot 18, would normally be aligned with the centre (in the direction normal to the plane of the paper) of the wire passage 16 and the centre of the cradle 11.

An alternative trap can be constructed in which the cradle 11 is replaced by a straight receptor (which can be thought of as being the lower limb 11*a* of the cradle as shown in FIGS. 2 to 4) and this need not be of electrically conducting material. Generally it is desirable for there to be at least a length of 0.5 mm between the end of the cradle 11 (or its equivalent straight receptor) closest to the wire passage 16 and the narrow end of the V-slot 18 in the closed condition of the trap (i.e. the distance shown "m" in FIG. 2). Distances for "m" in the range 0.5 mm to 2.0 mm would be typical with stranded wires of cross-sectional areas in the range 0.5 $mm^2$ to 1.5 $mm^2$. Where a straight receptor is used it is important to ensure there is some mechanical relationship between the two trap parts so that in the closed condition the two trap parts are kept close enough to lock the wire end therebetween. A gap typically of not more than 1 mm (unsprung) will be required for wires of the cross-sectional areas stipulated above.

It is surprising that the U-shaped cradle 11 can be dispensed with and it is felt that this has been made possible by the improved current-carrying capacity and contact-security that follows from the use of a slot 18 in the blade 12.

Figure 5:
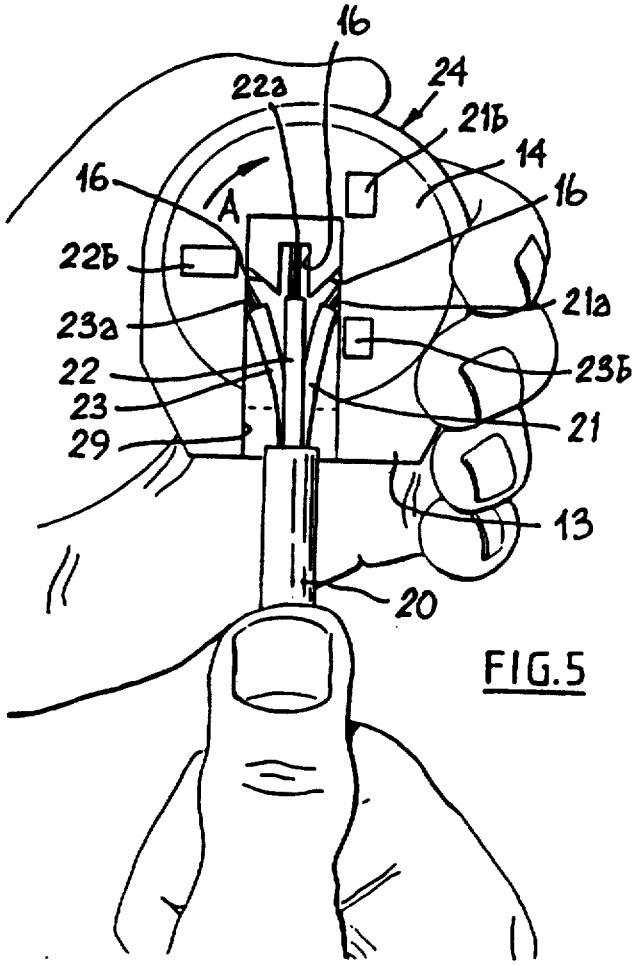
FIG. 5 shows a 3-pin electrical plug to which the invention has been applied with the plug housing in its open condition.
Figure 6:
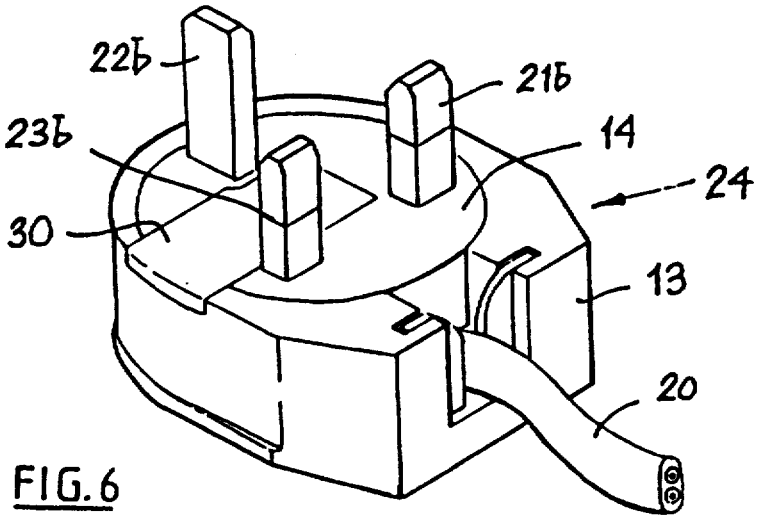
FIG. 6 shows a perspective view of the plug of FIG. 5 with its plug housing in the closed condition.

FIGS. 5 and 6 show an electrical three-pin plug which incorporates three wire traps (not shown) in accordance with the invention.

FIG. 5 shows a three-core electrical cable 20 with neutral wire 21, an earth wire 22 and a live wire 23 exposed for equal lengths within the housing 24 of the three-pin plug. Each wire 21–23 has its end 21*a*, 22*a*, 23*a* bared and located in a respective wire passage 16 leading to a respective two-part trap 10 of the kind described with reference to FIGS. 1 to 4. After inserting the wire ends 21*a*–23*a* fully into the respective passages 16, the central core 14 of the housing 24 is turned in the direction of the arrow A relative to the outer cap 13 of the housing, to close all three traps substantially simultaneously and leave each pin 21*b*, 22*b*, 23*b* electrically connected to the respective wire end 21*a*, 22*a*, 23*a* via a wedging in the respective slot 18 and entrapment of the respective blade 12 in the cradle 11. FIG. 6 shows the plug in this condition with a fuse carrier 30 occupying the opening 29 in the core 14 of the plug and locking the central core 14 in the outer cap 13 in the position in which all three wire traps are in their closed condition. A cartridge fuse (not shown) in the fuse carrier is now electrically interposed between the trap for the live wire 23 and the pin 23*b* therefor.

I claim:

1. For an electrical connector having two relatively-movable housing components displaceable between an open position and a closed position, and a wire passage in one of said components to receive a wire end with the terminal end of the wire projecting from one end of the passage, an improved wire trap positioned adjacent the one end of the passage comprising coacting first and second parts carried by the respective relatively-movable components of said housing, said first and second parts being spaced apart on opposite sides of said passage when said housing is in the open position and being overlapped when the housing is in the closed position, the improvement wherein the coacting parts of the wire trap are adapted, when the housing components are displaced from open to closed position, to bend a wire extending from the passage transverse to the passage and to trap the bent wire between the overlapped parts, said first part being provided with a slot in the mouth end thereof which confronts the second part when the housing is in the open position, said slot narrowing in the direction away from said mouth end whereby the relatively-movable first and second parts of the wire trap act to wedge the wire end into the slot in the closed position.

2. A wire trap according to claim 1, wherein the first part is a blade exhibiting a generally V-shaped slot and the second part is a plate-shaped member against which the wire end is pressed by the first member.

3. A wire trap according to claim 1, wherein the first part is a blade exhibiting a generally V-shaped slot and the second part is a generally U-shaped receptor having the plane of the U normal to the plane of the V and into which receptor the blade enters in the closed position of the housing.

4. A wire trap according to claim 1, wherein the slot is generally V-shaped and has a semi-angle in the range from 10° to 45°.

5. A wire trap according to claim 1, wherein the slot provides a taper of a semi-angle of about 50° at a mouth thereof and a narrower taper of a semi-angle of about 12° towards the closed end thereof.

6. A wire trap according to claim 1, wherein the slot is a straight-edged V-shaped slot of semi-angle between 20° and 30° and a depth of the slot measured along the line bisecting the angle of between 4 and 6 mm.

7. An electrical connector for a plurality of wires incorporating a plurality of wire traps according to claim 1, one for each of the plurality of wires, wherein the wire traps are ganged together so that upon relative movement of the components of the housing from the open position into the closed position, a trap snags each wire in the slot of the first part of the respective trap, as the closing of the components squeezes the wire between the two parts.

8. A connector according to claim 7, wherein the components are mounted for relative rotary movement about a turning axis, and the relative movement of the components of the housing closes and opens the wire trap parts circumferentially of said turning axis.

9. A three-trap connector according to claim 8 in which the housing is in the form of a three-pin electrical plug, the housing components comprising a central core turnable within an outer cap, pins projecting from one side of the central core, and a wire-receiving opening in the central core, each pin being in electrical contact with one part of a respective wire trap, the wire passage of each of said plurality of wire traps being in said central core and leading from said wire-receiving opening to the respective one of the three wire traps.

10. A connector according to claim 9 including a fuse carrier adapted to engage in the wire-receiving opening of the central core and having a part adapted to engage the outer cap and prevent relative turning of the core in the outer cap and thus a reopening of the wire traps.

11. For an electrical connector having two relatively-movable housing components displaceable between an open position and a closed position, and a wire passage in one of said components to receive a wire end with the terminal end of the wire projecting from one end of the passage, an improved wire trap positioned adjacent the one end of the passage comprising coacting first and second parts carried by the respective relatively-movable components of said housing, said first and second parts being spaced apart on opposite sides of said passage when said housing is in the open position and being overlapped when the housing is in the closed position, the improvement wherein the coacting parts of the wire trap are adapted, when the housing components are displaced from open to closed position, to bend a wire extending from the passage transverse to the passage and to trap the bent wire between the overlapped parts, said first part being provided with a slot in the mouth end thereof which confronts the second part when the housing is in the open position, said slot narrowing in the direction away from said mouth end whereby the displacement of the relatively-movable components of the housing from the open position to the closed position concomitantly bends the wire end transverse to said wire passage to lie between the first and second trap parts, bends the wire end transversely again to lie in said narrowing slot in said first trap part, and wedges the wire in said narrowing slot as the trap closes.

12. For an electrical connector having two relatively-movable housing components displaceable between an open position and a closed position, and a wire passage in one of said components to receive a wire end with the terminal end of the wire projecting from one end of the passage, an improved wire trap positioned adjacent the one end of the passage comprising a first blade part coacting with a second U-shaped receptor part carried by the respective relatively-movable components of said housing, said first and second parts being spaced apart on opposite sides of said passage when said housing is in the open position and the blade part inserted within the U-shaped part when the housing is in the closed position, the improvement wherein the coacting parts of the wire trap are adapted, when the housing components are displaced from open to closed position, to bend a wire extending from the passage transverse to the passage and to bend the end of the wire into a U-shaped to trap the bent wire between the inserted parts, said first part being provided with a slot in the mouth end thereof which confronts the second part when the housing is in the open position, said slot narrowing in the direction away from said mouth end whereby the relatively-movable first and second parts of the wire trap act to wedge the U-shaped wire end into the slot in the closed position.

* * * * *